United States Patent [19]

Uesugi et al.

[11] 4,389,627

[45] Jun. 21, 1983

[54] CHANGEOVER SWITCH FOR ACTUATING A PLURALITY OF REED SWITCHES DISPOSED IN A CIRCLE

[75] Inventors: Toshiaki Uesugi; Toshikazu Inden, both of Oi, Japan

[73] Assignee: Chino Works, Ltd., Saitama, Japan

[21] Appl. No.: 323,074

[22] Filed: Nov. 19, 1981

[30] Foreign Application Priority Data

Nov. 19, 1980 [JP] Japan ..... 55-164633

[51] Int. Cl.[3] ..... H01H 36/00

[52] U.S. Cl. ..... 335/206; 335/112; 335/152; 335/207

[58] Field of Search ..... 335/206, 207, 205, 152, 335/112, 153, 114

[56] References Cited

U.S. PATENT DOCUMENTS

| | | | |
|---|---|---|---|
| 3,162,738 | 12/1964 | Abramson et al. | 335/152 |
| 3,254,174 | 5/1966 | Elliott | 335/114 |
| 4,137,512 | 1/1979 | Sidor | 335/206 |

FOREIGN PATENT DOCUMENTS

| | | | |
|---|---|---|---|
| 1223022 | 8/1966 | Fed. Rep. of Germany | 335/206 |
| 1289901 | 2/1969 | Fed. Rep. of Germany | 335/206 |
| 1065597 | 4/1967 | United Kingdom | 335/206 |

*Primary Examiner*—Harold Broome

*Attorney, Agent, or Firm*—Oblon, Fisher, Spivak, McClelland & Maier

[57] ABSTRACT

A changeover switch comprising first and second substrates assembled in spaced relation to each other, a plurality of reed switches disposed in a circle having predetermined angular intervals on the substrates, a permanent magnet pivotally mounted on a revolving disc so as to lie in the same plane as the first and second substrates for causing the reed switches to switch on and off alternately as it is revolved between the first and second substrates, and a means for intermittently rotating the permanent magnet at an angle of every 90° around its pivotal axis.

8 Claims, 11 Drawing Figures

CHANGEOVER SWITCH FOR ACTUATING A PLURALITY OF REED SWITCHES DISPOSED IN A CIRCLE

BACKGROUND OF THE INVENTION

1. Field of the Invention

This invention relates to an electrical changeover switch adapted for use in switching inputs to be applied to a recorder, and more particularly to a magnetically operated changeover switch for alternately switching on and off a plurality of reed switches arranged on a substrate by means of a permanent magnet moving above the reed switches in proximate relationship thereto.

2. Description of the Prior Arts

In a changeover switch which includes a plurality of reed switches disposed in a circle having its center lying on an axis of rotation of a permanent magnet, the reed switches must be disposed at predetermined angular intervals in order to prevent the magnetic lines of force induced by the permanent magnet from exerting influence upon the adjacent reed switches which are switched on and off independently. Accordingly, the conventional changeover switch provided with a plurality of the reed switches is necessarily larger in size, and it is restricted to dispose each of the reed switches under the same temperature conditions to achieve the operational accuracy as in a compact changeover switch.

SUMMARY OF THE INVENTION

The present invention has been devised in view of the foregoing disadvantages in the prior art.

Accordingly, it is an object of the present invention to provide a changeover switch having a plurality of reed switches which are arranged closely in a small space and are free from malfunctioning caused by exerting magnetic lines of force induced by a permanent magnet to influence upon the reed switches which are not being operated.

It is another object of the present invention to provide a compact changeover switch which is capable of disposing each of reed switches under the substantially same temperature condition so that it may significantly reduce a measuring error due to the temperature difference when it is used for a changeover switch in measuring instruments.

It is a further object of the present invention to provide a changeover switch adapted for use in a measuring instrument which is capable of reducing a measuring error caused by defects in wirings formed on a substrate for electrically connecting reed switches to external appliances.

It is a further object of the present invention to provide a changeover switch adapted for use in a measuring instrument which includes a wiring pattern for permitting the wiring resistance to balance in high precision, thereby to reduce a measuring error caused by defects in the wiring formed on a substrate for electrically connecting reed switches to external appliances.

According to the present invention, the foregoing and other objects are attained by providing a changeover switch which includes a plurality of reed switches disposed in a circle, a permanent magnet moving above the reed switches in proximate relationship thereto for alternately switching on and off the reed switches as it is revolved above the reed switches, and a means for intermittently rotating the permanent magnet at a predetermined angle around its axis. In the present invention, it is possible to provide the changeover switch which is capable of operating the reed switches twice as much as the prior art device without increasing overall dimension of the changeover switch.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENT

A changeover switch according to an embodiment of the present invention will be hereinafter described with reference to the accompanying drawings.

Figure 1:
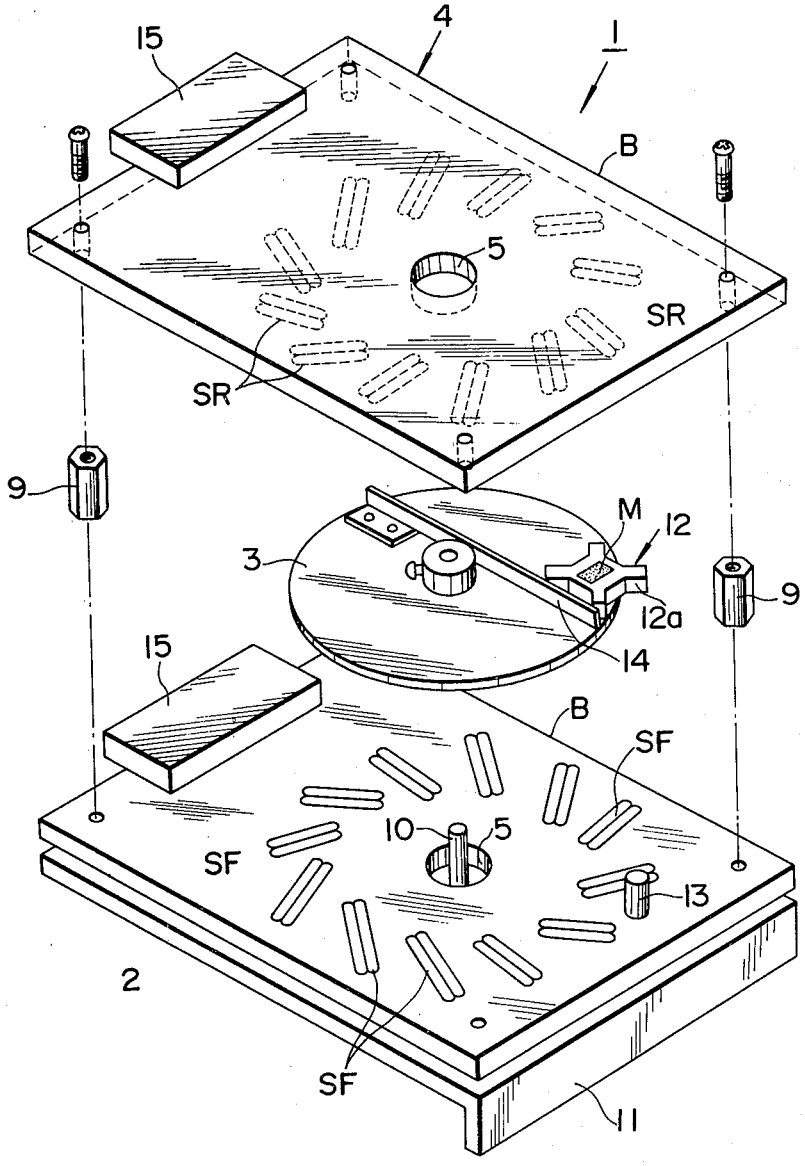
FIG. 1 is an exploded perspective view of a changeover switch according to the present invention.
Figure 2:
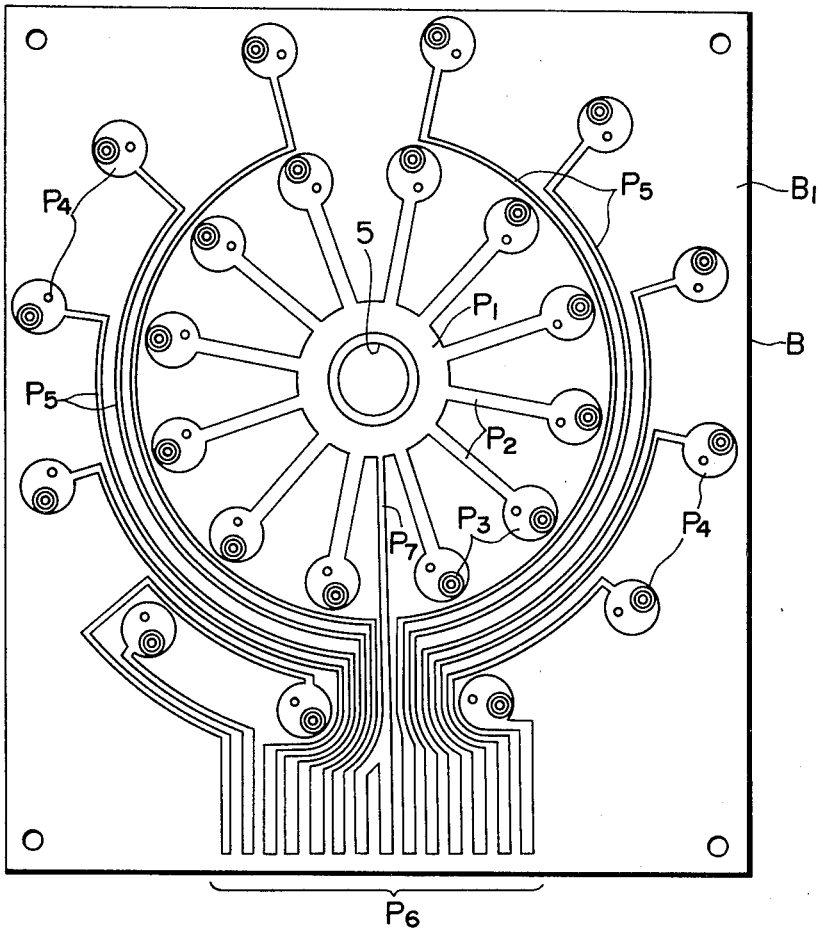
FIG. 2 is a plan view of a wiring pattern formed on the front surface of a substrate of the changeover switch shown in FIG. 1.
Figure 3:
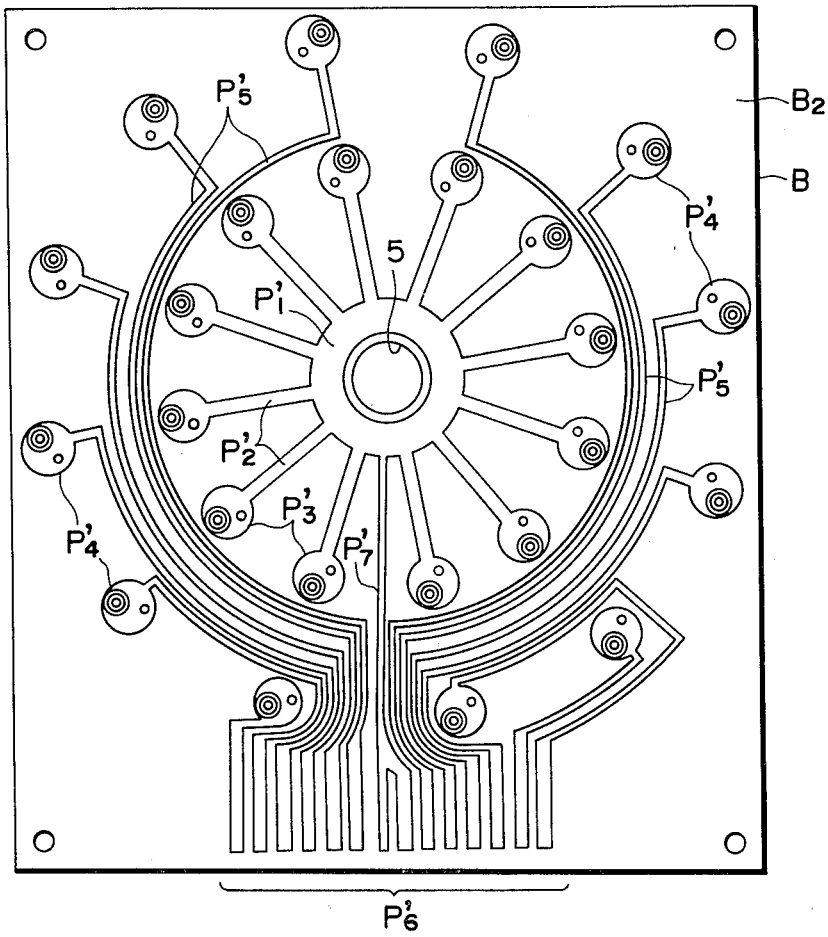
FIG. 3 is a plan view of a wiring pattern formed on the rear surface of a substrate of the changeover switch shown in FIG. 1.

Referring now to FIG. 1, the changeover switch generally indicated by the reference numeral 1 comprises a first substrate 2, a magnet revolving disc 3 and a second substrate 4, which are disposed in a superposed relationship. The first substrate 2 includes a printed wiring board B having an opening 5 at the center thereof and twelve sets of reed switches arranging in pairs are disposed on the wiring board B. On the front and rear surfaces of the wiring board B, there are formed wiring patterns P and P′ having the configuration as shown in FIGS. 2 and 3. As is apparent from FIGS. 2 and 3, the wiring patterns P and P′ printed on both the front and rear surfaces of the wiring board are symmetrical with each other.

Referring to the wiring pattern P printed on the surface $B_1$ of the wiring board B shown in FIG. 2, the wiring pattern P includes a ring-shaped conductor $P_1$ formed around the central opening 5 of the wiring board B. The ring-shaped conductor $P_1$ is provided with twelve wiring strips $P_2$ radially extending from the outer periphery thereof which are substantially the same length and include small disc-shaped terminals $P_3$ to be connected to one end of contact strips of the reed switches SF. In addition, there are formed twelve small disc-shaped terminals $P_4$ to be connected to the other end of the contact strips of the reed switches SF around the outer periphery of the terminals $P_3$. Each of the terminals $P_4$ is extended to outer terminal contact members $P_6$ formed at the marginal edge of the wiring board B through arcuate wirings $P_5$ disposed between the terminals $P_3$ and $P_4$. The ring-shaped conductor $P_1$ is extended to the outer terminal contact members $P_6$ through a conductive path $P_7$.

Figure 4:
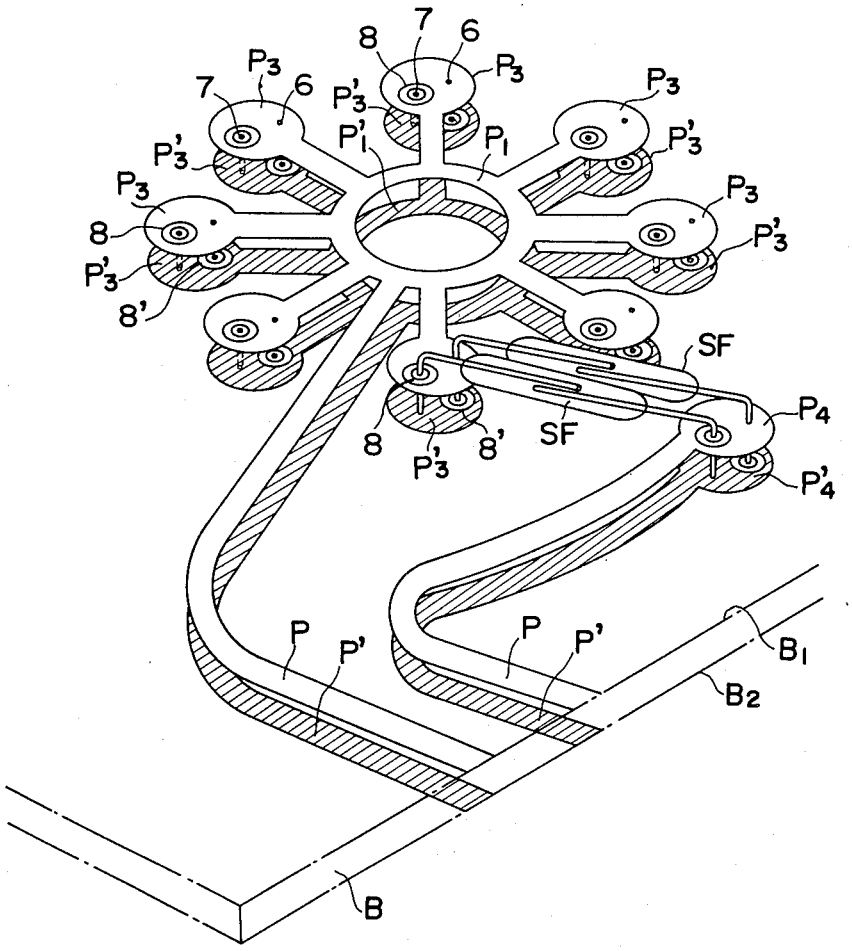
FIG. 4 is a schematic perspective view of the wiring patterns shown in FIGS. 2 and 3 illustrating the interrelationship thereof.

As explained above, the rear surface $B_2$ of the printed wiring board B is provided with the wiring pattern P' as shown in FIG. 3 which is symmetrical with the wiring pattern P shown in FIG. 2. As is apparent from FIG. 4, terminals $P'_3$ and $P'_4$ of the wiring pattern P' are formed on the rear surface $B_2$ of the printed wiring board B so as to be opposite to the terminals $P_3$ and $P_4$ formed on the front surface of the printed wiring board B.

The small disc-shaped terminals $P_3$ and $P_4$ includes two holes 6 and 7 for permitting the reed-shaped contact strips of the reed switches SF to pass therethrough and extend to the reverse side terminals $P'_3$ and $P'_4$. The hole 7 is electrically insulated from the hole 6 by means of an insulating portion 8 which is formed by removing the wiring conductor around the hole 7. Thus, the contact strips of the reed switch SF passing through and fixing to the holes 7 are electrically insulated from the terminals $P_3$ and $P_4$ by the provision of the insulating portions 8. The contact strips of the reed switch SF passing through and fixing to the hole 6 are electrically integrated with the terminals $P_3$ and $P_4$. In the same manner, there is formed an insulating portion 8' removing the wiring conductor around the hole 6 on the reverse side terminals $P'_3$ and $P'_4$. The contact strips of the reed switch SF passing through and fixing to the hole 6 are electrically insulated from the terminals $P'_3$ and $P'_4$ by the provision of the insulating portion 8', and the contact strips of the reed switch SF passing through and fixing to the hole 7 are electrically integrated with the terminals $P_3$ and $P_4$.

Figure 5:
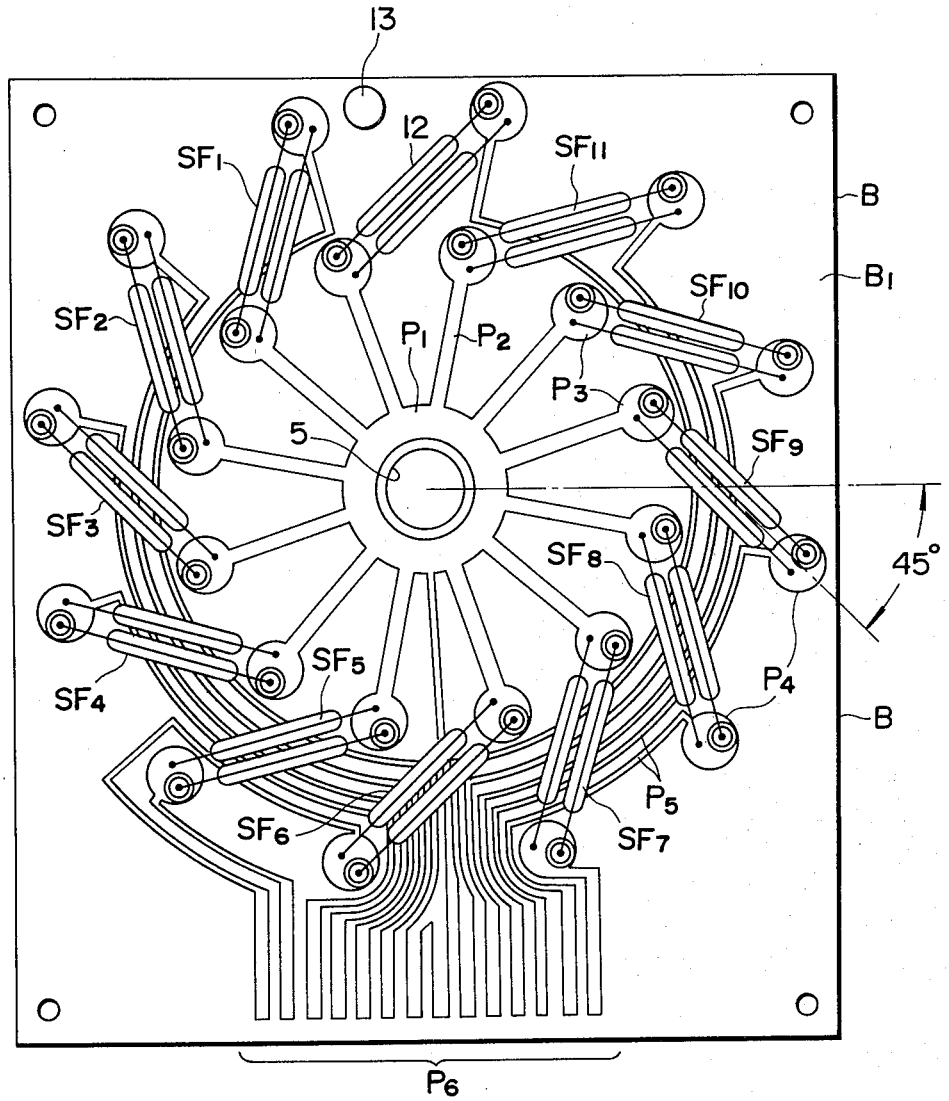
FIG. 5 is a plan view of the substrate on which a plurality of reed switches are mounted.

As shown in FIG. 5, the twelve sets of reed switches arranging in pair $SF_1$ to $SF_{12}$ are disposed on the surface of the board B on both the front and rear surfaces of which the wiring patterns P and P' are printed so that each of the reed switches $SF_1$ to $SF_{12}$ may be disposed at an angle of 45° with respect to a line radially extending from the center of the opening 5.

Figure 6:
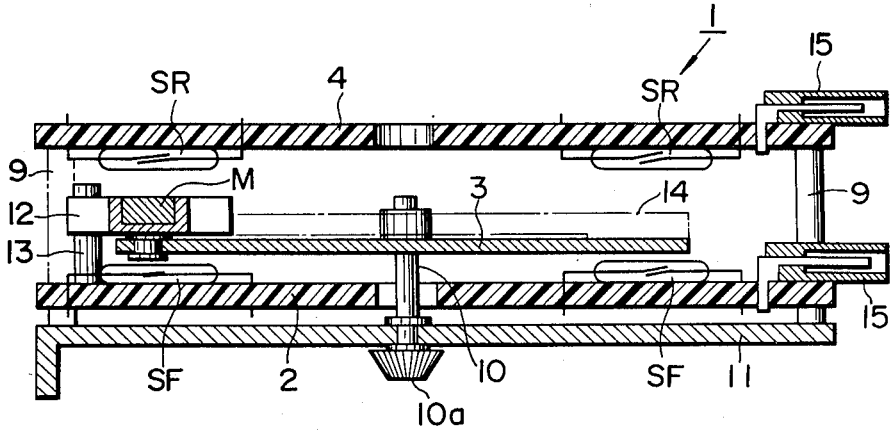
FIG. 6 is a longitudinal sectional view of the changeover switch shown in FIG. 1.
Figure 7:
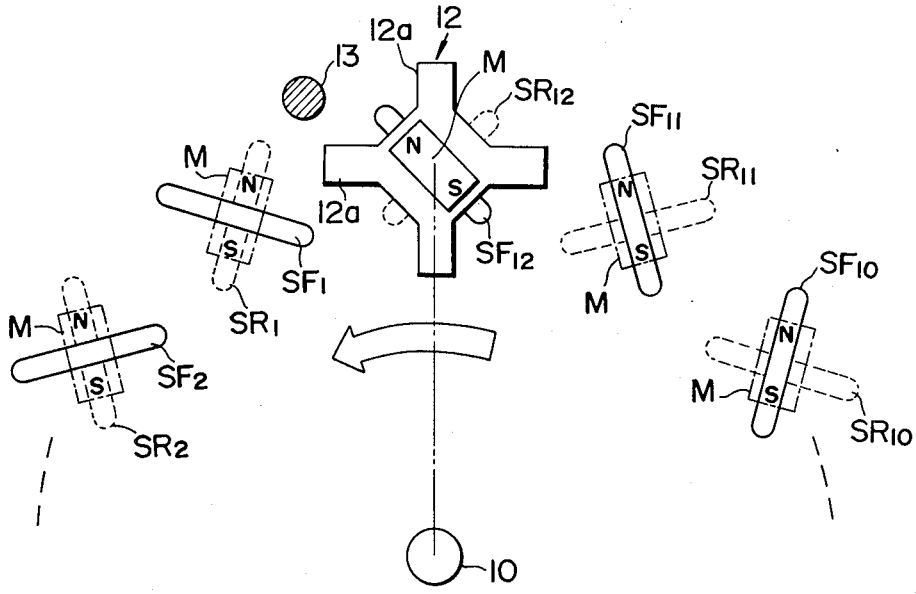
FIG. 7 is a schematic diagram illustrating operation of the changeover switch according to the present invention.

The second substrate 4 is provided with wiring patterns P and P' and reed switches SR which are equivalent to those used in the first substrate 2. The first and second substrates 2 and 4 are assembled as shown in FIG. 6 by using spacers 9 so that each of the substrate surfaces $B_1$ on which the reed switches are mounted may be opposite to each other. When the substrates 2 and 4 assembled, the reed switches SF of the first substrate 2 lie in a plane opposite and perpendicular to the reed switches SR of the second substrate 4 as shown in FIG. 7.

The permanent magnet revolving disc 3 disposed between the first and second substrates 2 and 4 is provided with a boss at the center thereof which is fixed to a rotary shaft 10 projecting from the center opening 5 of the first substrate 2. The rotary shaft 10 is rotatably supported by a frame 11 under the first substrate 2 as shown in FIG. 6. The rotary shaft 10 is projected through the frame 11 and a bevel gear **10*a* mounted at the projected end thereof to be connected to a driving motor (not shown). At the marginal edge of the permanent magnet revolving disc 3, there is provided a rotor 12 which is pivotally mounted on the disc and lies in the same plane as the reed switches SF and SR. Embeded at the central portion of the rotor 12 is a permanent magnet M which is rotated together with the rotor 12 so that axis of polarity of the magnet may be changed. As shown in FIGS. 1 and 7, the rotor 12 includes four levers 12*a* projected from the corners thereof which cause the rotor 12 to rotate intermittently by engaging the lever 12*a* with a pin 13 fixedly mounted on the first substrate when the permanent magnet revolving disc 3 is rotated. The angle of the rotation of the rotor 12 at the time of engaging the lever 12*a* with a pin 13 is restricted at 90° by a leaf spring 14 fixed to the revolving disc 3 being in contact with the levers 12*a* of the rotor 12**.

The outer terminal contact member P6 formed at the marginal edge of the first and second substrates 2 and 4 is electrically connected to connectors 15, which, in turn, connect the changeover switch 1 to resistance thermometers installed in various places.

Figure 8:
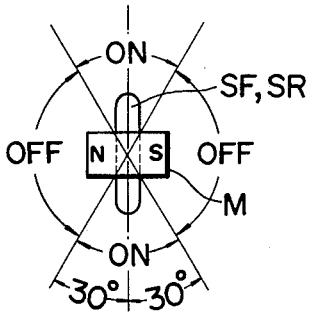
FIG. 8 serves to illustrate the operation range of reed switch.
Figure 9:
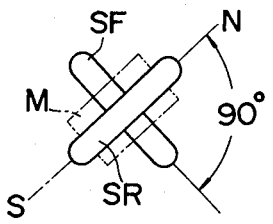
FIG. 9 is a schematical plan view of the reed switches illustrating the relationship between the reed switches and a permanent magnet.

Referring now to the operation of the changeover switch according to the present invention, the reed switches SF and SR have an operation range as shown in FIG. 8. That is, the reed switches SF and SR will close when the axis of polarity of the permanent magnet M actuating the reed switches SF and SR is substantially parallel to the longitudinal axis of the reed switches SF and SR, while the reed switches SF and SR will open when the axis of polarity of the permanent magnet M is substantially perpendicular to the longitudinal axis of the reed switches SF and SR. It is noted that the closing range of the reed switches SF and SR is narrower than the opening range of the reed switches SF and SR. The closing range of the reed switches SF and SR can be defined as approximately ±30° from the center of the longitudinal axis of the reed switches SF and SR as shown in FIG. 8. Accordingly, when the axis of polarity of the permanent magnet M is parallel to the longitudinal axis of the reed switch SR and perpendicular to the longitudinal axis of the reed switch SR, the reed switch SR will be switched on and the reed switch SF will be switched off.

When rotating the permanent magnet revolving disc 3 to cause the permanent magnet M to revolve around the rotary shaft 10, the reed switches $SF_1$ to $SF_{12}$ mounted on the first substrate 2 aligning its longitudinal axis with the axis of polarity of the permanent magnet M are switched on and off alternately. At this time, the reed switches SR mounted on the second substrate 4 are not actuated by the magnet M and put in its opened position, because the longitudinal axis of the reed switches SR is perpendicular to the axis of polarity of the permanent magnet M. After one revolution of the permanent magnet M which causes the reed switches $SF_1$ to $SF_{12}$ to switch on and off, the rotor 12 is subjected to rotate at an angle of 90° by the pin 13 which engages with the lever **12*a* of the rotor 12 and causes to rotate the rotor 12. Then, the axis of polarity of the permanent magnet M is rotated at an angle of 90°, and the axis of polarity of the permanent magnet M becomes parallel to the longitudinal axis of the reed switches SR. When the magnet M is revolved in this position, the reed switches SR on the second substrate 4 are switched on and off alternately. At this time, the reed switches SF mounted on the first substrate 2 are not actuated by the magnet M and put in its open position, because the longitudinal axis of the reed switch SF is perpendicular to the axis of polarity of the permanent magnet M. When such operations are repeated, the twenty four sets of the reed switches SF and SR mounted on the changeover switch 1** are switched on and off alternately.

Figure 10:
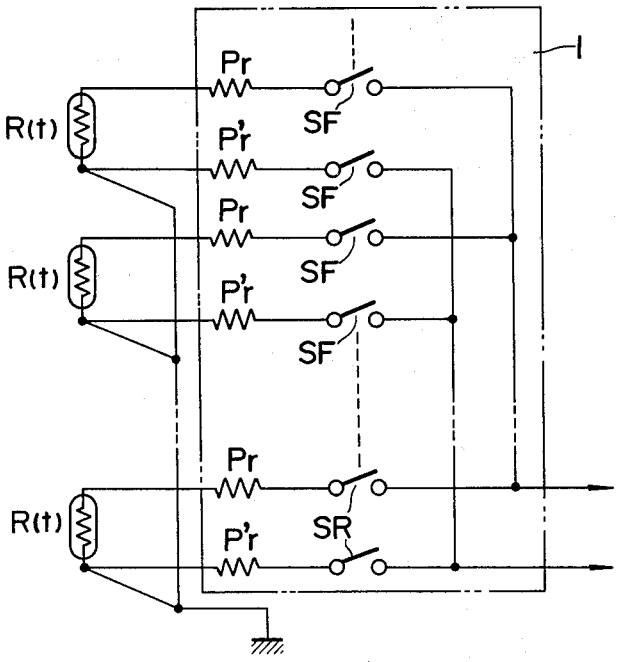
FIG. 10 is a circuit diagram of the changeover switch adapted for use in a recorder in which the printed wiring board according to the present invention is incorporated.
Figure 11:
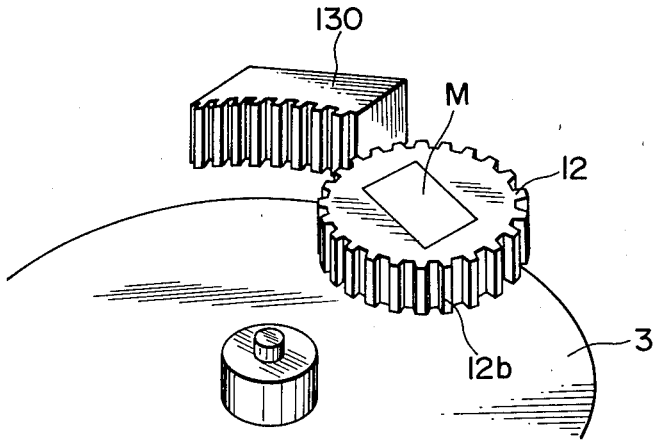
FIG. 11 is a perspective view of the essential portion of the changeover switch according to another embodiment of the present invention.

The wiring patterns P and P' formed on each of the substrates 2 and 4 have relatively high resistances Pr and Pr', respectively. For example, the wiring pattern of 0.5 mm in width has resistance of 10 to 15 mΩ/cm. However, the wiring patterns P and P' formed on the front and rear surfaces of the substrate B are symmetrical with each other. Thus, the resistance of the wiring pattern P printed on the front surface of the substrate B will be equivalent to that of the wiring pattern P' printed on the rear surface of the substrate B. Accordingly, when one of the reed switches SF or SR arranging in pair is connected to the wiring pattern P printed on the front surface of the substrate B and the remaining reed switch is connected to the wiring pattern P' printed on the rear surface of the substrate B as shown in FIG. 10, the resistances Pr and Pr' of a pair of the wirings connected to both ends of the resistance thermometer R(t) will be equal, which makes it possible to detect variation of the resistance in the resistance thermometer R(t) precisely without being affected by the resistance of the wiring patterns P and P'.

It is to be understood that the changeover switch according to the present invention may be modified in various ways. For example, it may be constructed to include a rotor 12 having teeth **12*b* around the periphery thereof which is engaged with a block 130 so that the rotor 12 may be intermittently rotated at an angle of every 90° in associated with the rotor 12 and the block 130**. Furthermore, each of the substrates may be provided with the permanent magnet which is coaxially rotated instead of providing the single magnet interposed between the two substrate as in the embodiment explained above.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A changeover switch comprising at least one substrate;

a permanent magnet defining an axis of polarity and revolving about a first axis in a circle in proximity to said substrate, said permanent magnet being rotatable about a second axis in the circle around which said permanent magnet revolves;

a plurality of reed switches mounted on said substrate, said reed switches being disposed in a circle having its center lying on the first axis of revolution of said permanent magnet and switched on and off alternately in response to the magnetic lines of force of said permanent magnet when the axis of polarity of said magnet is aligned with said reed switches; and a means for intermittently rotating said permanent magnet a predetermined angle about said second axis during each revolution of said magnet about said first axis, thereby deviating the axis of polarity of said permanent magnet with respect to said reed switches and placing said reed switches under actuated or unactuated conditions in dependence on the rotation of said permanent magnet about said second axis.

2. The changeover switch as defined in claim 1 wherein said means for intermittently rotating said permanent magnet comprises a pin fixed to said substrate having levers projected from the outer periphery of said magnet, said levers being engageable with said pin each revolution of said magnet.

3. The changeover switch as defined in claim 1 wherein said means for intermittently rotating said permanent magnet comprises a block mounted on said substrate having a gear formed on the outer periphery of said magnet, said block having teeth on one surface thereof and being engageable with said gear each revolution of said magnet.

4. A changeover switch comprising first and second substrates assembled in spaced relation to each other;

a plurality of reed switches disposed in a circle having predetermined angular intervals on said first and second substrates, said reed switches being disposed in opposite and different angular relationship with each other;

a permanent magnet revolving about a first axis in a circle between said first and second substrates in proximity to said reed switches; and means for intermittently rotating the angular orientation of said magnet about a second axis during revolution thereof about said first axis such that selected of said reed switches are actuated in dependence on the angular orientation of said magnet about said second axis during revolution of said magnet about said first axis.

5. The changeover switch as defined in claim 1, wherein said reed switches are arranged in pair to be adjacent to each other so as to be simultaneously switched on and off by said permanent magnet.

6. The changeover switch as defined in claim 1, wherein said substrate includes a printed wiring board, said printed wiring board having a printed wiring formed on one surface thereof to be electrically connected to contact strips of said reed switches.

7. The changeover switch as defined in claim 5, wherein said substrate include a printed wiring board, said printed wiring board having printed wirings formed on both front and rear surfaces thereof to be electrically connected to contact strips of each pair of said reed switches.

8. The changeover switch as defined in claim 7, wherein said printed wirings having wiring patterns symmetrical with each other.

* * * * *